US010456900B2

(12) United States Patent
Liou

(10) Patent No.: US 10,456,900 B2
(45) Date of Patent: Oct. 29, 2019

(54) QUICK-TURN DRIVING TOOL

(71) Applicant: Mou-Tang Liou, Taichung (TW)

(72) Inventor: Mou-Tang Liou, Taichung (TW)

( * ) Notice: Subject to any disclaimer, the term of this patent is extended or adjusted under 35 U.S.C. 154(b) by 127 days.

(21) Appl. No.: 15/225,866

(22) Filed: Aug. 2, 2016

(65) Prior Publication Data

US 2018/0036874 A1 Feb. 8, 2018

(51) Int. Cl.

| | |
|---|---|
| ***B25G 1/00*** | (2006.01) |
| ***B25B 13/06*** | (2006.01) |
| ***B25B 23/16*** | (2006.01) |
| ***B25G 1/06*** | (2006.01) |

(52) U.S. Cl.

CPC ..... *B25G 1/005* (2013.01); *B25B 13/06* (2013.01); *B25B 23/16* (2013.01); *B25G 1/063* (2013.01)

(58) Field of Classification Search

CPC ..... B25G 1/063; B25G 1/005; B25G 1/06; Y10T 403/592; B25B 13/06; B25B 23/16

USPC ..... 81/177.1, 177.85, 489, 415, 416, 417, 81/177.5; 403/DIG. 6, 164, 165, 166, 403/321, 322.1, 322.2, 322.3, 325

See application file for complete search history.

(56) References Cited

U.S. PATENT DOCUMENTS 1,864,466 A * 6/1932 Peterson ..... B25B 23/0035 279/2.12
2,179,594 A * 11/1939 Johnson ..... E21B 31/20 294/86.22
2,220,354 A * 11/1940 Sheetz ..... B25B 23/065 221/279
4,643,472 A * 2/1987 Schukei ..... B66C 1/56 294/82.28
6,840,703 B2 * 1/2005 Blanchard ..... F16B 19/109 248/429
7,228,766 B1 * 6/2007 Shyu ..... B25B 13/005 81/125.1
7,331,261 B2 * 2/2008 Blizniuk ..... B25B 23/0035 81/124.4
8,528,449 B2 * 9/2013 Cheng ..... B25B 23/0021 81/177.5
2004/0173061 A1 * 9/2004 Liou ..... B25B 23/0035 81/177.85
2006/0016298 A1 * 1/2006 Chang ..... B25B 13/005 81/177.5
2009/0060644 A1 * 3/2009 Blanchard ..... A01B 33/028 403/321
2011/0056339 A1 * 3/2011 Su ..... B25B 15/001 81/177.85
2011/0079118 A1 * 4/2011 Lee ..... B25B 23/16 81/177.7

(Continued)

*Primary Examiner* — Hadi Shakeri

(74) *Attorney, Agent, or Firm* — Alan D. Kamrath; Karin L. Williams; Mayer & Williams PC

(57) ABSTRACT

A driving tool includes a body and an auxiliary handle. The body includes a first rod and a second rod perpendicular to each other. The first rod includes an insertion hole and at least one receiving slot. The second rod is mounted between two opposite ends of the first rod. The auxiliary handle includes a connection slot mounted on the body and an engaging recess. An adjusting member is mounted in the insertion hole and movable in relation to the first rod. At least one engaging member is received in the receiving slot and the engaging recess and is abutted against the adjusting member. Thus, the auxiliary handle is freely rotatable relative to the first rod.

5 Claims, 10 Drawing Sheets

FIG. 10

(56) References Cited

U.S. PATENT DOCUMENTS

2012/0167726 A1* 7/2012 Cheng ..... B25B 23/0021
81/177.5
2012/0174458 A1* 7/2012 Burnsed, Jr. ..... F41C 23/02
42/85

* cited by examiner

QUICK-TURN DRIVING TOOL

BACKGROUND OF THE INVENTION

The present invention relates to a driving tool and, more particularly, to a driving tool capable of swiftly turning objects, such as nuts and bolts. U.S. Patent Publication NO. 2011/0079118 discloses a hand tool including a main body and a sleeve element. The sleeve element is rotatably disposed on the main body. As such, a user can hold the sleeve element while rotating the main body quickly to drive a workpiece.

However, when a user holds the sleeve element and rotates the main body, a collision easily occurs between the handle portion and the user's hand holding the sleeve element.

The present invention is, therefore, intended to obviate or at least alleviate the problems encountered in the prior art.

BRIEF SUMMARY OF THE INVENTION

The present invention solves this need and other problems in the field of driving tools by providing a driving tool including a body and an auxiliary handle.

The body includes a first rod extending along a first axis, and a second rod extending along a second axis perpendicular to the first axis. The first rod includes a driving end and an operating end spaced from the driving end along the first axis. The first rod includes an insertion hole extending from the operating end along the first axis, and at least one receiving slot extending along a radial direction perpendicular to the first axis. One end of the receiving slot is interconnected with the insertion hole, and another end of the receiving slot is connected to an outer periphery of the first rod. The second rod is mounted between the driving end and the operating end of the first rod.

The auxiliary handle includes a connection slot disposed at one end thereof and mounted on the operating end of the body along the first axis. The auxiliary handle includes an engaging recess extending around an inner periphery of the connection slot. The auxiliary handle further includes an adjusting member and at least one engaging member. The adjusting member is mounted in the insertion hole and is movable in relation to the first rod along the first axis. The adjusting member includes a cone portion disposed at one end thereof. The engaging member is received in the receiving slot. One end of the engaging member is abutted against the cone portion, and another end of the engaging member is engaged in the engaging recess. The auxiliary handle is freely rotatable relative to the first rod about the first axis. The first rod further includes a through hole disposed between the driving end and the operating end and extending along the radial direction perpendicular to the first axis. The second rod is inserted through the through hole and is movable in relation to the first rod along the second axis.

In an embodiment, the first rod further includes a sliding slot disposed between the driving end and the operating end and extending along the radial direction perpendicular to the first axis. A channel is disposed between the through hole and the sliding slot. One end of the channel is interconnected with the through hole, and another end of the channel is interconnected with the sliding slot. The second rod includes a plurality of positioning recesses each extending along a radial direction perpendicular to the second axis. The body further includes a control member and a positioning member. The control member is slidably received in the sliding slot and is movable in relation to the first rod between a locking position and a release position. The positioning member is arranged in the channel and is movable in relation to the first rod.

When the control member is in the locking position, the control member abuts against the positioning member to cause the positioning member to engage in one of the positioning recesses.

When the control member is in the release position, the positioning member is disengaged from the positioning recess.

In another embodiment, a channel is disposed between the insertion hole and the through hole and extending along the first axis. One end of the channel is interconnected with the insertion hole, and another end of the channel is interconnected with the through hole. The body further includes a positioning member and an elastic member. The positioning member and the elastic member are received in the channel. The positioning member is disposed adjacent to the second rod. One end of the elastic member abuts against the positioning member, and another end of the elastic member abuts against the adjusting member. The elastic member can abut against the positioning member to cause the positioning member to engage in one of the positioning recesses.

The connection slot extends opposite to the body and penetrates through the auxiliary handle being a round tube.

The adjusting member is threadedly engaged in the insertion hole.

The first rod includes a plurality of receiving slots arranged at equal intervals around the circumference of the first rod. The auxiliary handle includes a plurality of engaging members respectively received in the plurality of receiving slots. The number of receiving slots is equal to the number of engaging members.

The engaging member is a ball.

The second rod includes first, second, and third positioning recesses. The first and second positioning recesses are disposed at two opposite ends of the second rod, and the third positioning recess is disposed between the first and second positioning recesses.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
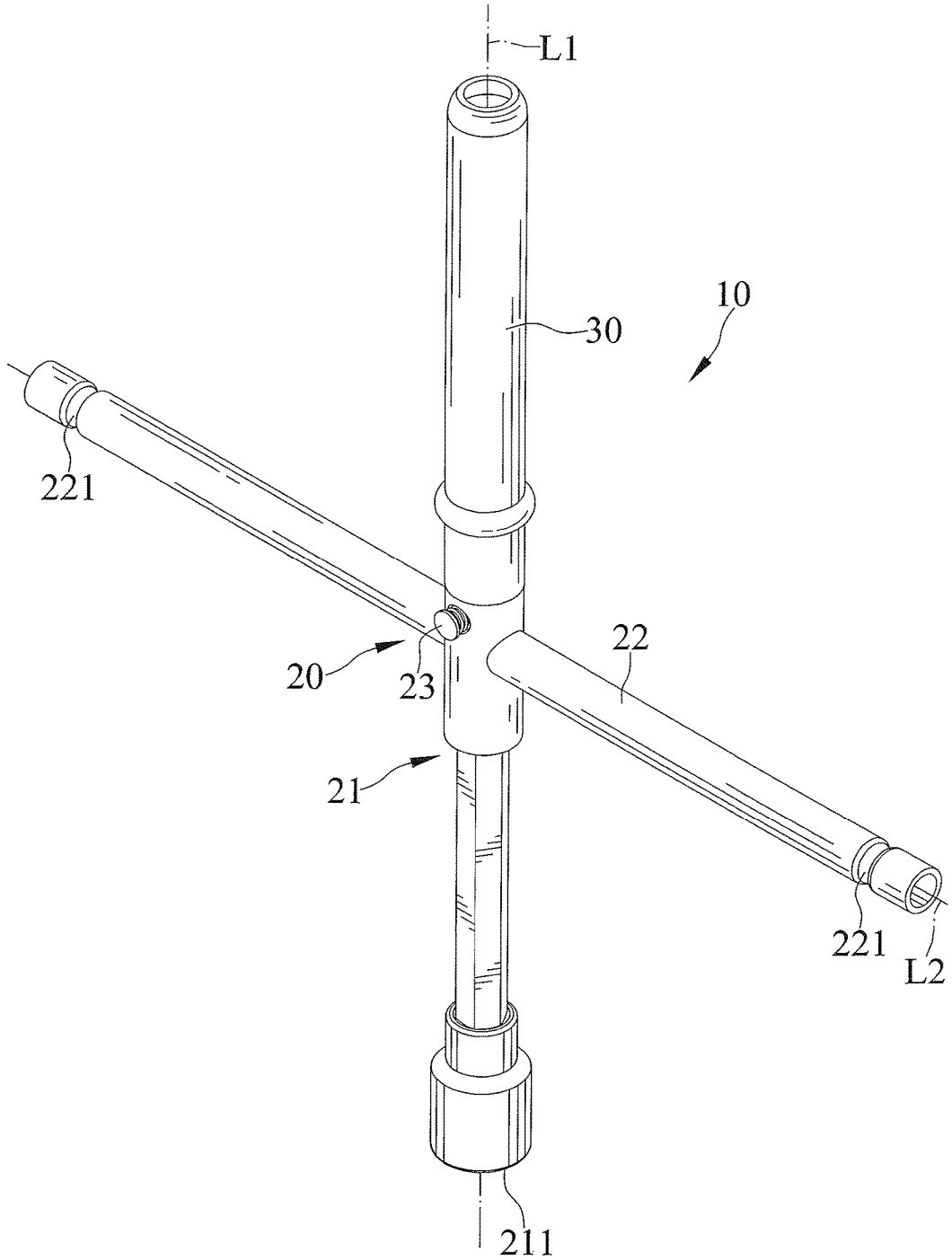
FIG. 1 shows a perspective view of a driving tool of a first embodiment according to the present invention.
Figure 2:
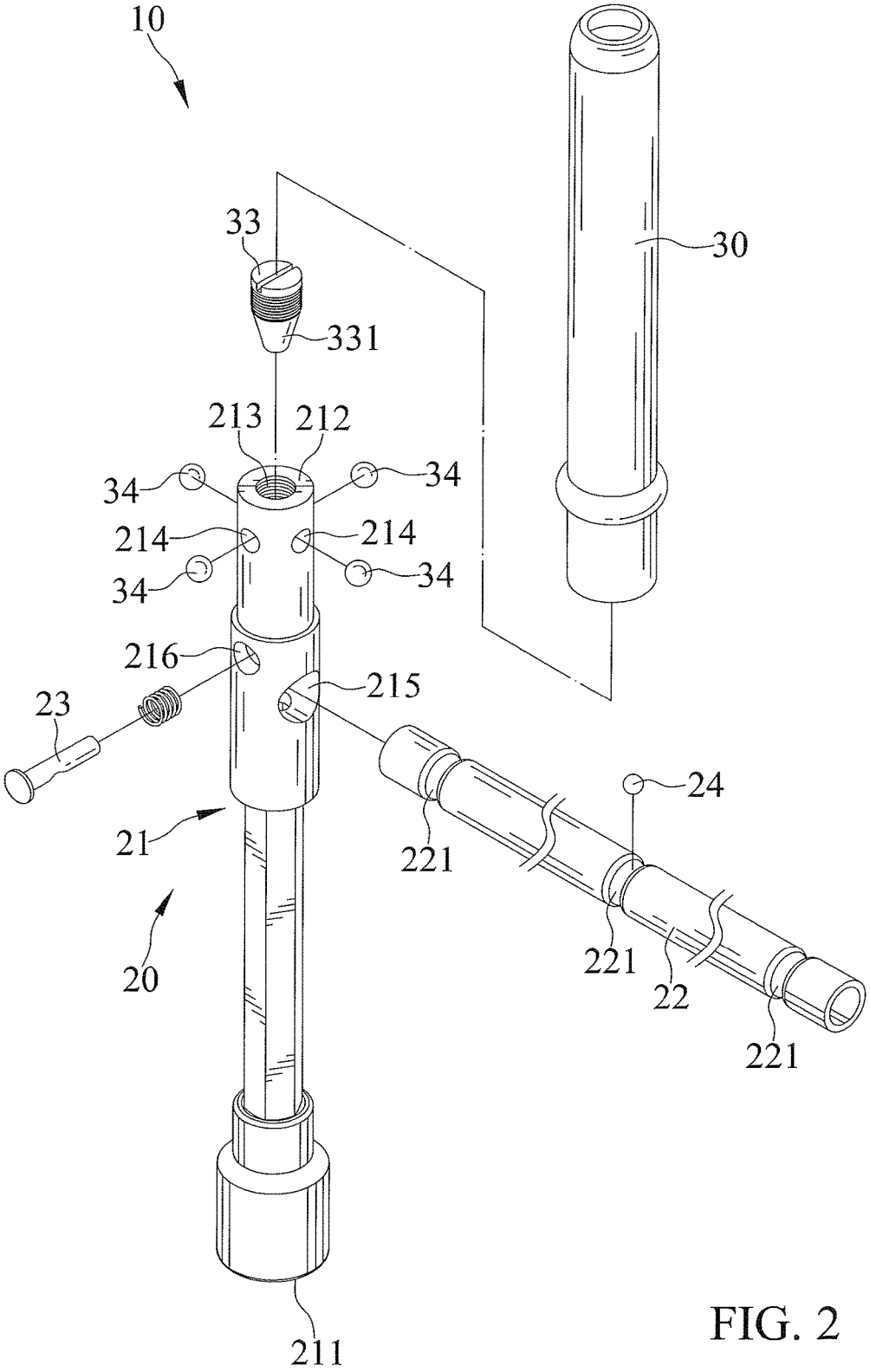
FIG. 2 shows an exploded, perspective view of the driving tool of FIG. 1.
Figure 3:
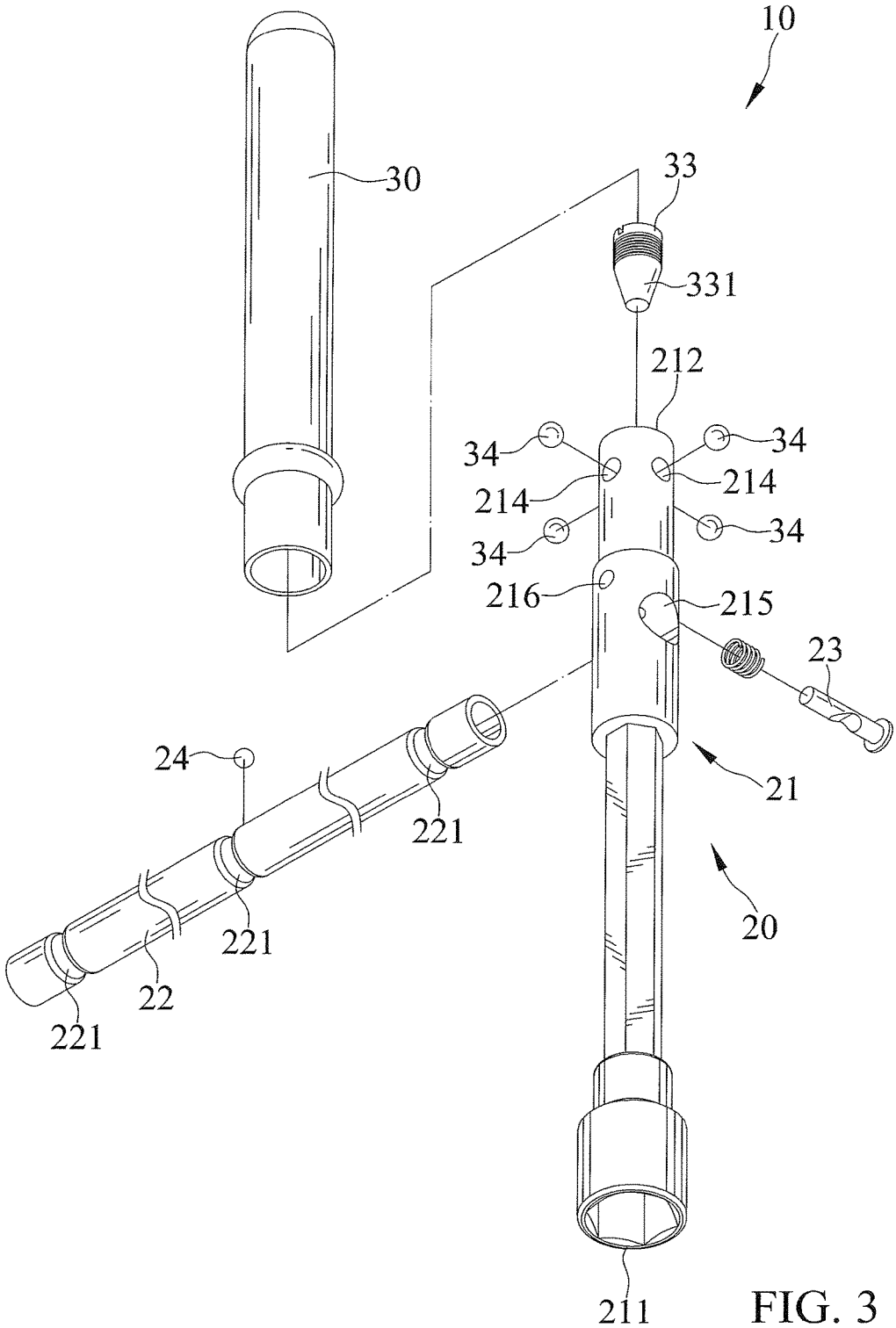
FIG. 3 shows another exploded, perspective view of the driving tool of FIG. 1.
Figure 4:
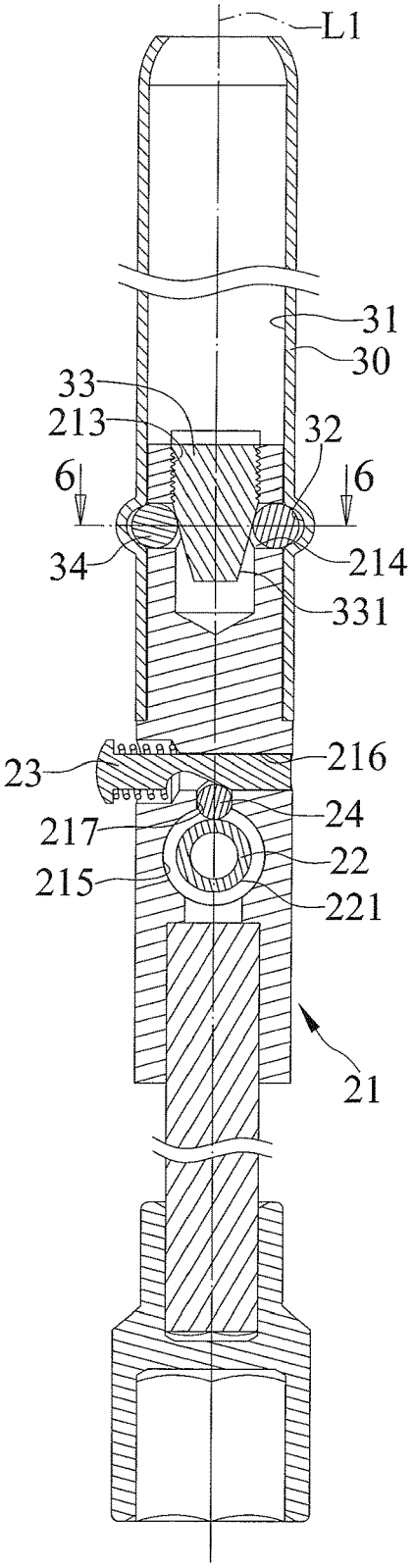
FIG. 4 shows a cross-section view of the driving tool of FIG. 1, and illustrates a control member located in a locking position.
Figure 5:
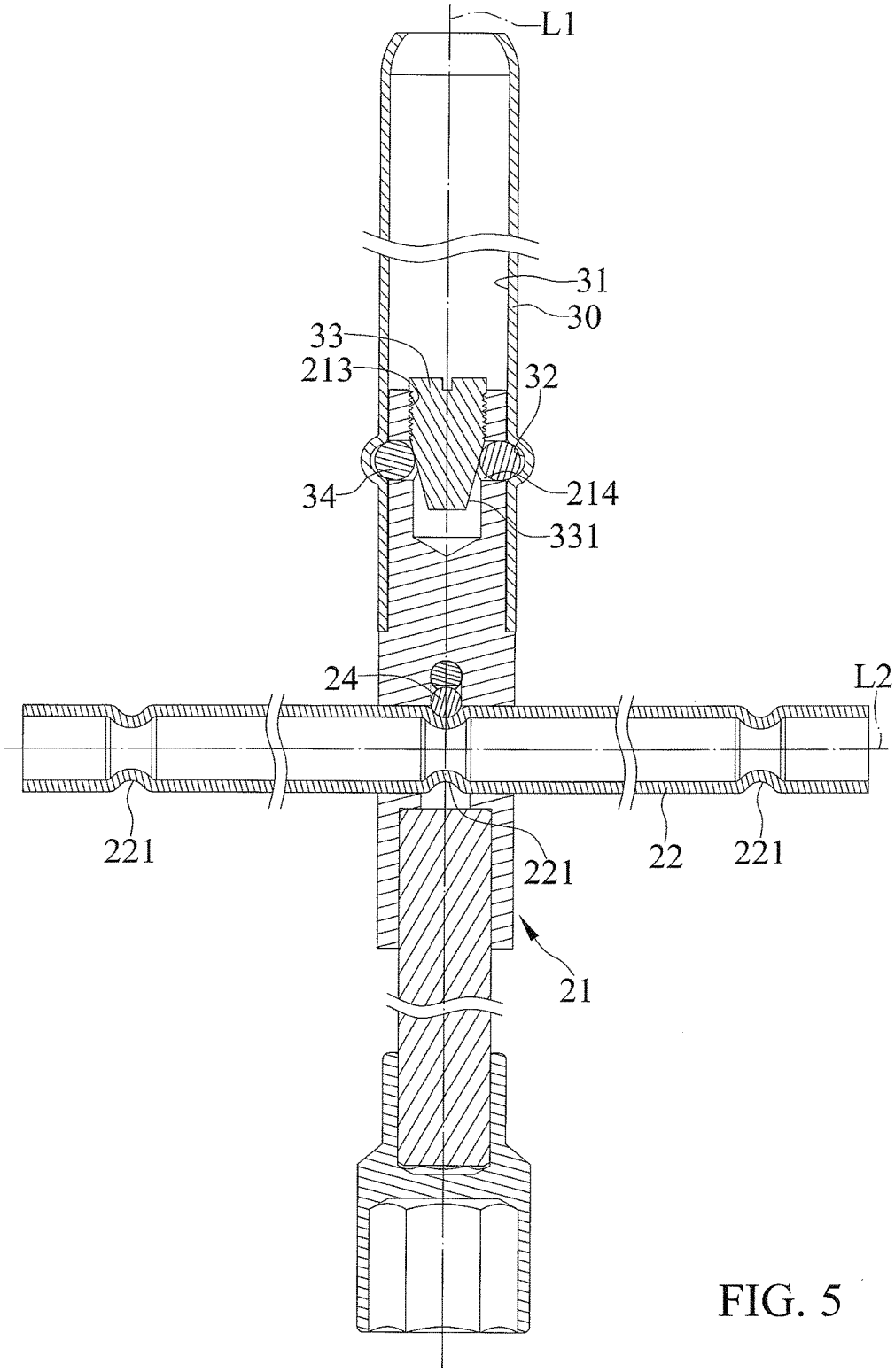
FIG. 5 shows another cross-section view of the driving tool of FIG. 1.
Figure 6:
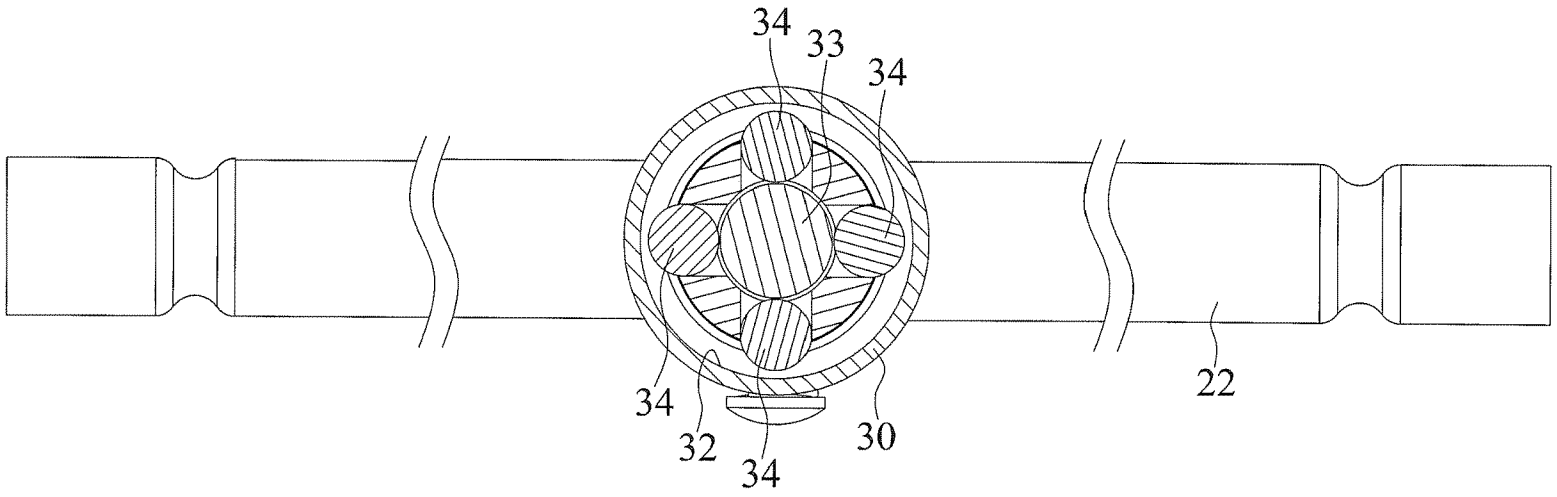
FIG. 6 shows a cross-section view taken along line 6-6 of FIG. 4.
Figure 7:
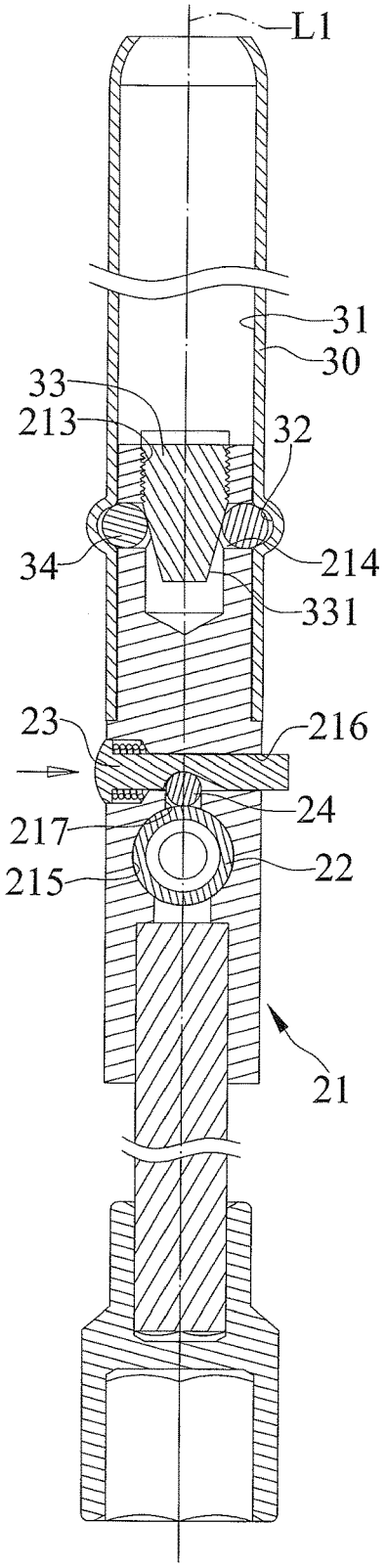
FIG. 7 shows a cross-section view of the driving tool of FIG. 1, and illustrates the control member moved from the locking position to a release position.
Figure 8:
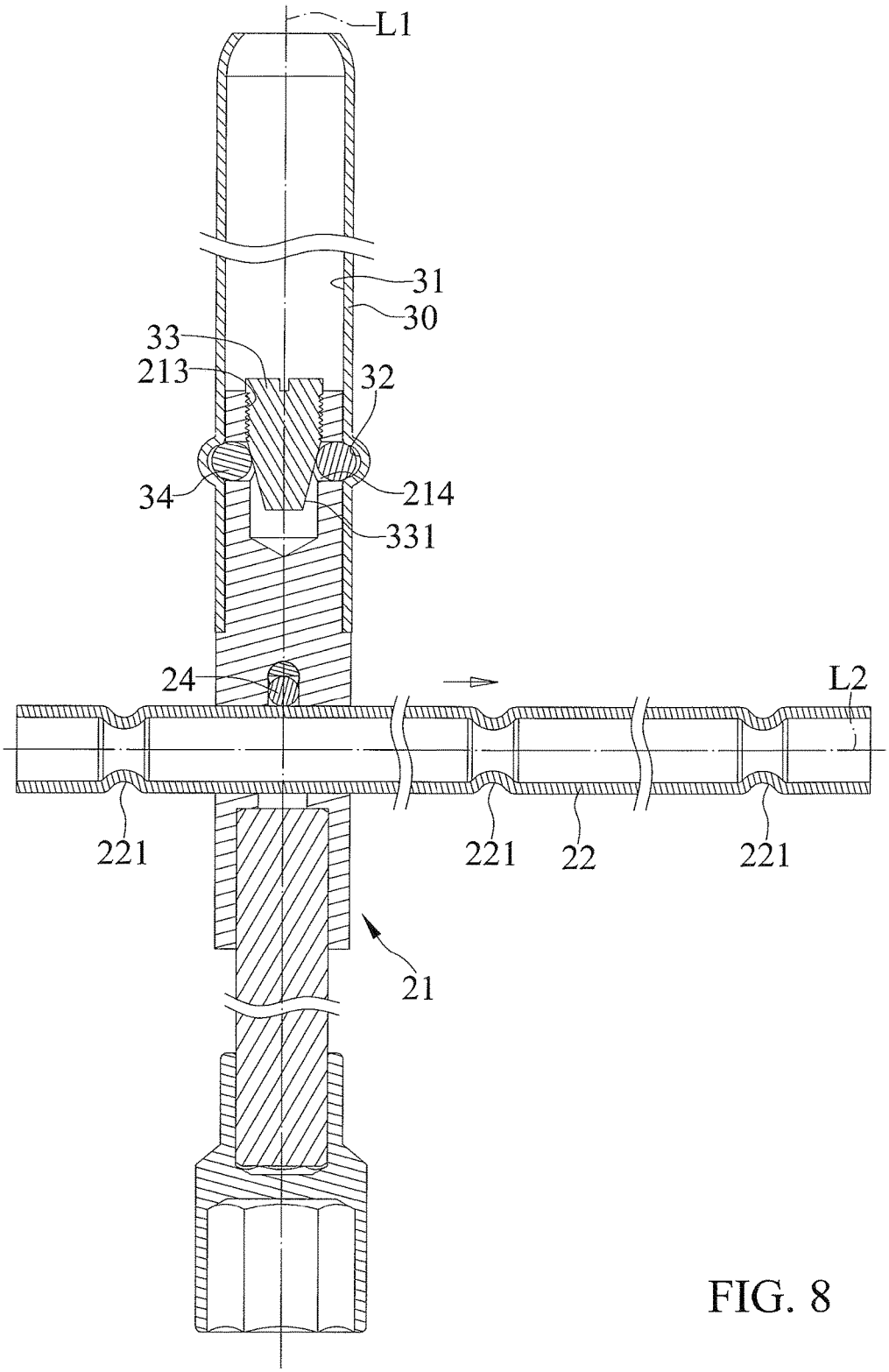
FIG. 8 shows another cross-section view of the driving tool of FIG. 1, and illustrates the control member moved from the locking position to a release position.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

FIGS. 1-8 show a driving tool 10 of a first embodiment according to the present invention. The driving tool 10 includes a body 20 and an auxiliary handle 30 rotatably mounted on the body 20.

The body 20 includes a first rod 21 extending along a first axis L1, and a second rod 22 extending along a second axis L2 perpendicular to the first axis L1. The first rod 21 includes a driving end 211 and an operating end 212 spaced from the driving end 211 along the first axis L1. The first rod 21 includes an insertion hole 213 extending from the operating end 212 toward the driving end 211 along the first axis L1, and at least one receiving slot 214 extending along a radial direction perpendicular to the first axis L1. One end of the receiving slot 214 is interconnected with the insertion hole 213, and another end of the receiving slot 214 is connected to an outer periphery of the first rod 21. In the embodiment, the first rod 21 includes four receiving slots 214 arranged at equal intervals around the circumference of the first rod 21.

The first rod 21 further includes a through hole 215 and a sliding slot 216 both disposed between the driving end 211 and the operating end 212 and extending along the radial direction perpendicular to the first axis L1. A channel 217 is disposed between the through hole 215 and the sliding slot 216. One end of the channel 217 is interconnected with the through hole 215, and another end of the channel 217 is interconnected with the sliding slot 216.

The second rod 22 is mounted between the driving end 211 and the operating end 212 of the first rod 21. Further, the second rod 22 is inserted through the through hole 215 and is movable in relation to the first rod 21 along the second axis L2. The second rod 22 includes a plurality of positioning recesses 221 each extending along a radial direction perpendicular to the second axis L2. Further, the positioning recesses 221 are formed around the circumference of the second rod 22. In the embodiment, the second rod 22 includes first, second, and third positioning recesses 221. The first and second positioning recesses 221 are disposed at two opposite ends of the second rod 22 spaced from each other along the second axis L2, and the third positioning recess 221 is disposed between the first and second positioning recesses 221.

The body 20 further includes a control member 23 and a positioning member 24. The control member 23 is slidably received in the sliding slot 216 and is movable in relation to the first rod 21 between a locking position and a release position. The positioning member 24 is arranged in the channel 217 and is movable in relation to the first rod 21. When the control member 23 is in the locking position, the control member 23 abuts against the positioning member 24 to cause the positioning member 24 to engage in one of the positioning recesses 221. When the control member 23 is in the release position, the positioning member 24 is disengaged from the positioning recess 221.

The auxiliary handle 30 includes a connection slot 31 disposed at one end thereof and mounted on the operating end 212 of the body 20 along the first axis L1. In the embodiment, the connection slot 31 extends opposite to the body 20 and penetrates through the auxiliary handle 30, which is a round tube. The auxiliary handle 30 includes an engaging recess 32 circumferencely extending around an inner periphery of the connection slot 31.

The auxiliary handle 30 further includes an adjusting member 33 and at least one engaging member 34. The adjusting member 33 is mounted in the insertion hole 213 and is movable in relation to the first rod 21 along the first axis L1. In the embodiment, the adjusting member 33 is threadedly engaged in the insertion hole 213. The adjusting member 33 includes a cone portion 331 disposed at one end thereof. The engaging member 34 is received in the receiving slot 214. One end of the engaging member 34 is abutted against the cone portion 331, and another end of the engaging member 34 is engaged in the engaging recess 32. Thus, the auxiliary handle 30 is freely rotatable relative to the first rod 21 about the first axis L1. In the embodiment, the auxiliary handle 30 includes four engaging members 34 respectively received in the four receiving slots 214, and the number of receiving slots 214 is equal to the number of engaging members 34. Furthermore, the engaging member 34 may be a ball.

The driving end 211 of the first rod 21 is adapted to connect to a fastener, such as a nut used to secure a wheel on a vehicle. One hand of a user can hold the auxiliary handle 30, and the other hand of the user can hold the second rod 22 for operation. The user can quickly turn the second rod 22 to drive the first rod 21 to continuously rotate for turning the fastener due to the auxiliary handle 30 being freely rotatable relative to the first rod 21 about the first axis L1. Moreover, the auxiliary handle 30 is adjacent to the user while operating the driving tool 10, so that the driving tool 10 is easy to operate.

Additionally, the cone portion 331 of the adjusting member 33 abuts against the engaging member 34. When the adjusting member 33 is threadedly moved deep into the insertion hole 213, the cone portion 331 of the adjusting member 33 abuts against the engaging member 34 to move outward. Conversely, when the adjusting member 33 is threadedly moved away from the insertion hole 213, the cone portion 331 of the adjusting member 33 sufficiently connects to the engaging member 34 to move inward for adjusting rotatable tightness between the auxiliary handle 30 and the first rod 21.

When the driving tool 10 is in a non-operational state, the control member 23 and the adjusting member 33 can be disassembled to cause the second rod 22 and the auxiliary handle 30 to be disengageable from the first rod 21. Thus, the first rod 21, the second rod 22, and the auxiliary handle 30 can respectively be arranged parallel to each other for storage, transportation, or sales for enhancing convenience and reducing storage space.

Figure 9:
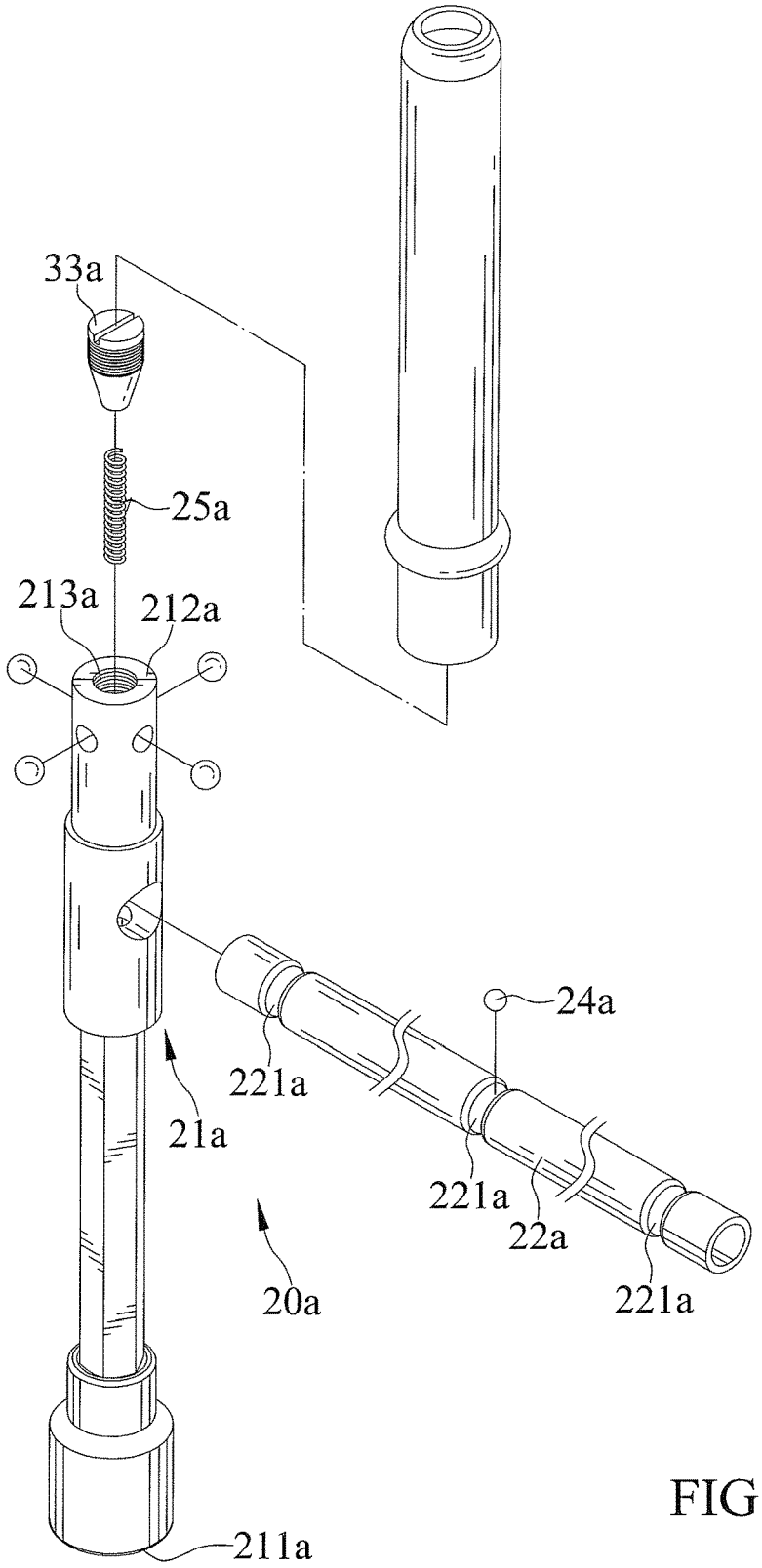
FIG. 9 shows an exploded, perspective view of a driving tool of a second embodiment according to the present invention.
Figure 10:
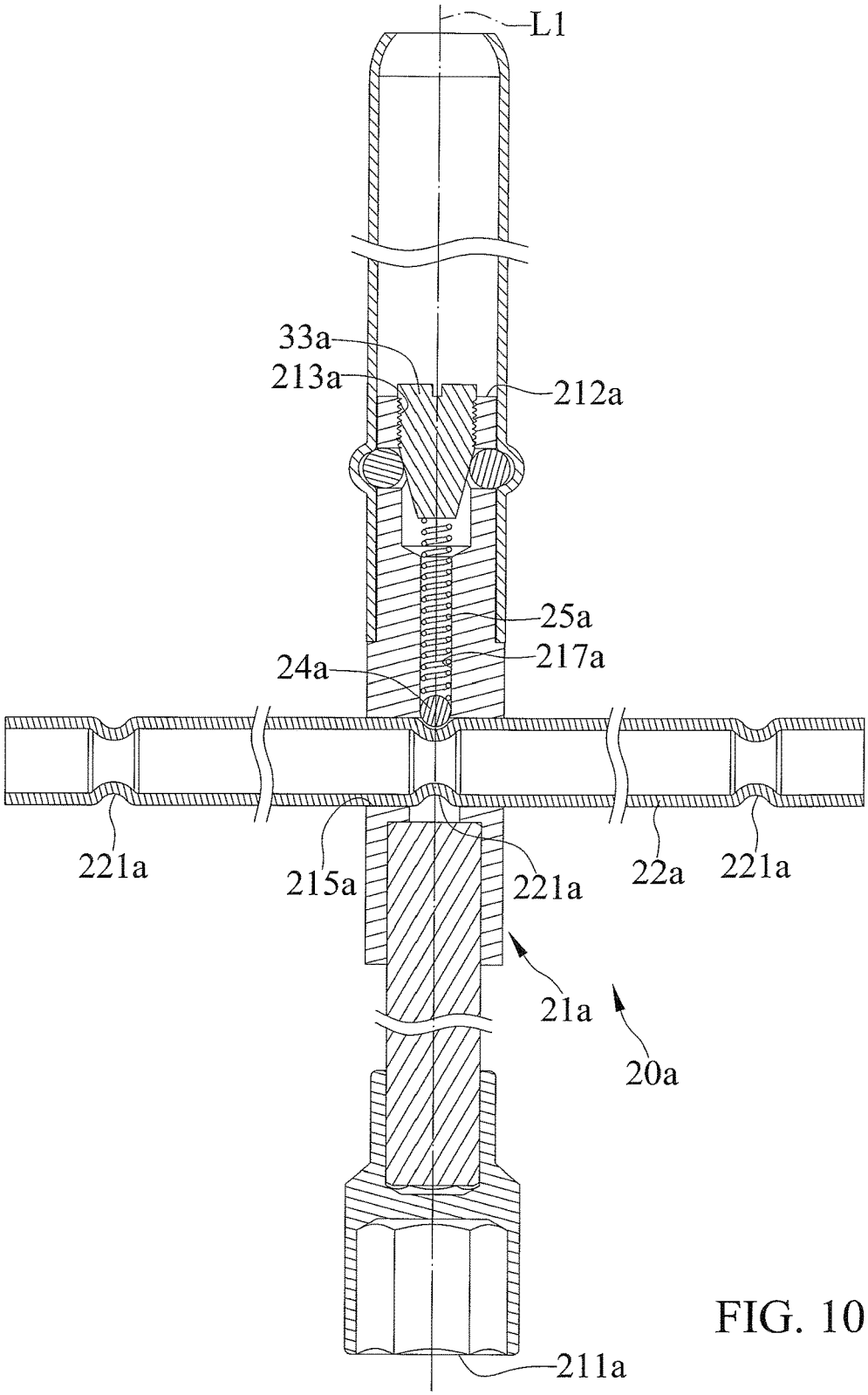
FIG. 10 shows a cross-section view of the driving tool of FIG. 9.

FIGS. 9 and 10 show a driving tool 10 of a second embodiment according to the present invention. The second embodiment is substantially the same as the first embodiment. The second embodiment is different from the first embodiment by that the first rod 21*a* includes a through hole 215*a* disposed between the driving end 211*a* and the operating end 212*a* and extending along the radial direction perpendicular to the first axis L1. A channel 217*a* is disposed between the insertion hole 213*a* and the through hole 215*a* and extends along the first axis L1. One end of the channel 217*a* is interconnected with the insertion hole 213*a*, and another end of the channel 217*a* is interconnected with the through hole 215*a*.

The body 20*a* includes a positioning member 24*a* and an elastic member 25*a*. The positioning member 24*a* and the elastic member 25*a* both are received in the channel 217*a*. The positioning member 24*a* is disposed adjacent to the second rod 22*a*. One end of the elastic member 25*a* abuts against the positioning member 24*a*, and another end of the elastic member 25*a* abuts against an end face of the adjusting member 33*a*. The elastic member 25*a* can abut against the positioning member 24*a* to cause the positioning member 24*a* to engage in one of the positioning recesses 221*a*. Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A driving tool comprising:

a body including a first rod extending along a first axis, and a second rod extending along a second axis perpendicular to the first axis, with the first rod including a driving end and an operating end spaced from the driving end along the first axis, with the first rod including an insertion hole extending from the operating end along the first axis, and at least one receiving slot extending along a radial direction perpendicular to the first axis, with one end of the at least one receiving slot interconnected with the insertion hole, with another end of the at least one receiving slot connected to an outer periphery of the first rod, with the second rod mounted between the driving end and the operating end of the first rod; and an auxiliary handle including a connection slot disposed at one end thereof and mounted on the operating end of the body along the first axis, with the auxiliary handle including an engaging recess extending around an inner periphery of the connection slot, with the auxiliary handle further including an adjusting member and at least one engaging member, with the adjusting member threadedly engaged in the insertion hole, with the adjusting member formed as a monolithic element including an integral cone portion disposed at one end thereof and movable in relation to the first rod along the first axis by threads disposed at another end thereof and threadably engaged in the insertion hole, with the integral cone portion having an outer periphery of a decreasing size with increasing spacing from the threads, with the at least one engaging member received in the receiving slot, with one end of the at least one engaging member abutted against the outer periphery of the cone portion, with another end of the at least one engaging member engaged in the engaging recess, and with the auxiliary handle freely rotatable relative to the first rod about the first axis, with the first rod further including a through hole disposed between the driving end and the operating end and extending along the radial direction perpendicular to the first axis, with the second rod inserted through the through hole, and with the second rod movable in relation to the first rod along the second axis, with a channel disposed between the insertion hole and the through hole and extending along the first axis, with one end of the channel interconnected with the insertion hole, with another end of the channel interconnected with the through hole, with the second rod including a plurality of positioning recesses, with the body further including a positioning member and an elastic member, with the positioning member and the elastic member received in the channel, with the positioning member disposed adjacent to the second rod, with one end of the elastic member abutting against the positioning member, with another end of the elastic member abutting against the adjusting member, and with the elastic member abutting against the positioning member to cause the positioning member to engage in one of the plurality of positioning recesses of the second rod.

2. The driving tool as claimed in claim 1, with the connection slot extending opposite to the body and penetrating through the auxiliary handle being a round tube.

3. The driving tool as claimed in claim 1, with the at least one receiving slot including a plurality of receiving slots arranged at equal intervals around a circumference of the first rod, with the at least one engaging member including a plurality of engaging members respectively received in the plurality of receiving slots, and with a number of the plurality of receiving slots equal to a number of the plurality of engaging members.

4. The driving tool as claimed in claim 1, with the at least one engaging member being a ball.

5. The driving tool as claimed in claim 1, with the plurality of positioning recesses including first, second, and third positioning recesses, with the first and second positioning recesses disposed at two opposite ends of the second rod, and with the third positioning recess disposed between the first and second positioning recesses.

* * * * *